US010683668B2

(12) United States Patent
De Rick et al.

(10) Patent No.: US 10,683,668 B2
(45) Date of Patent: Jun. 16, 2020

(54) SET OF FLOOR PANELS AND METHOD FOR INSTALLING THIS SET OF FLOOR PANELS

(71) Applicant: FLOORING INDUSTRIES LIMITED, Bertrange (LU)

(72) Inventors: Jan Eddy De Rick, Geraardsbergen (BE); Bart Van Der Stockt, Zwalm (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 16/096,025

(22) PCT Filed: Apr. 19, 2017

(86) PCT No.: PCT/IB2017/052245
§ 371 (c)(1),
(2) Date: Oct. 24, 2018

(87) PCT Pub. No.: WO2017/187298
PCT Pub. Date: Nov. 2, 2017

(65) Prior Publication Data

US 2019/0136545 A1 May 9, 2019

(30) Foreign Application Priority Data

Apr. 25, 2016 (BE) ..... 2016/5282
Jan. 13, 2017 (BE) ..... 2017/5020

(51) Int. Cl.
*E04F 15/00* (2006.01)
*E04F 15/02* (2006.01)
*E04F 15/10* (2006.01)

(52) U.S. Cl.
CPC ..... *E04F 15/02038* (2013.01); *E04F 15/105* (2013.01); *E04F 15/107* (2013.01);
(Continued)

(58) Field of Classification Search
CPC ..... E04F 2201/023; E04F 15/02038; E04F 19/061; E04F 19/06; E04F 19/02;
(Continued)

(56) References Cited

U.S. PATENT DOCUMENTS 3,195,968 A * 7/1965 Freeman ..... A47B 47/042 312/263
5,893,617 A * 4/1999 Lee ..... A47B 47/0041 312/263

(Continued)

FOREIGN PATENT DOCUMENTS

BE 1023545 B1 4/2017
DE 102005039369 A1 2/2007

(Continued)

OTHER PUBLICATIONS

Belgian Search Report from BE Application No. BE 201605282, dated Jan. 13, 2017.

(Continued)

*Primary Examiner* — Gisele D Ford
(74) *Attorney, Agent, or Firm* — Workman Nydegger

(57) ABSTRACT

A set of floor panels, which is suitable for forming a floor covering in herringbone pattern, wherein these floor panels are oblong rectangular; wherein the long as well as the short edges are provided with mechanical coupling means; and wherein the male coupling part on the short edge can be inserted into the female coupling part on the long edge in one and the same turning movement which is used to insert the male coupling part on the long edge into the female coupling part on the long or short edge.

15 Claims, 7 Drawing Sheets

(52) U.S. Cl.
CPC ..... *E04F 2201/0115* (2013.01); *E04F 2201/0146* (2013.01); *E04F 2201/0153* (2013.01); *E04F 2201/0161* (2013.01); *E04F 2201/0535* (2013.01); *E04F 2201/0552* (2013.01)

(58) Field of Classification Search
CPC ... E04F 13/0871; E04F 11/163; E04F 19/022; F16B 5/0056; F16B 5/00; F16B 5/0012; F16B 5/0004; E04B 2001/3276; E04B 1/34321; E04B 2002/7483; E04B 2001/3252; E04B 1/6804; E04B 1/6809; B27M 3/08; A47B 47/0075; A47B 2230/0096
See application file for complete search history.

(56) References Cited

U.S. PATENT DOCUMENTS

| | | | | |
|---|---|---|---|---|
| 7,637,068 | B2 * | 12/2009 | Pervan | B27F 1/02 52/592.1 |
| 8,381,476 | B2 | 2/2013 | Hannig | |
| 9,156,233 | B2 | 10/2015 | Dossche et al. | |
| 2004/0168392 | A1 * | 9/2004 | Konzelmann | E04F 15/04 52/589.1 |
| 2006/0101769 | A1 * | 5/2006 | Pervan | E04F 15/02 52/591.1 |
| 2006/0236642 | A1 * | 10/2006 | Pervan | E04F 15/02 52/578 |
| 2006/0260254 | A1 * | 11/2006 | Pervan | E04F 15/02 52/592.1 |
| 2007/0006543 | A1 * | 1/2007 | Engstrom | E04F 15/02 52/582.1 |
| 2007/0175143 | A1 * | 8/2007 | Pervan | B44C 3/12 52/403.1 |
| 2007/0175156 | A1 * | 8/2007 | Pervan | B44C 1/28 52/582.1 |
| 2007/0193178 | A1 * | 8/2007 | Groeke | E04F 15/02 52/578 |
| 2008/0010937 | A1 * | 1/2008 | Pervan | E04F 15/02 52/588.1 |
| 2008/0104921 | A1 * | 5/2008 | Pervan | E04F 15/02 52/588.1 |
| 2008/0236088 | A1 * | 10/2008 | Hannig | B27M 3/0066 52/592.1 |
| 2009/0019806 | A1 * | 1/2009 | Muehlebach | E04F 15/02 52/588.1 |
| 2009/0100782 | A1 * | 4/2009 | Groeke | E04F 15/02 52/589.1 |
| 2009/0193748 | A1 * | 8/2009 | Boo | B27F 1/02 52/589.1 |
| 2010/0043333 | A1 | 2/2010 | Hannig | |
| 2010/0281803 | A1 * | 11/2010 | Cappelle | E04F 15/02 52/309.1 |
| 2011/0280655 | A1 * | 11/2011 | Maertens | E04F 15/045 403/375 |

FOREIGN PATENT DOCUMENTS

| | | | |
|---|---|---|---|
| EP | 1650375 | A1 | 4/2006 |
| WO | 9747834 | A1 | 12/1997 |
| WO | 2004063491 | A1 | 7/2004 |
| WO | 2004079130 | A1 | 9/2004 |
| WO | 2005054599 | A1 | 6/2005 |
| WO | 2008008016 | A1 | 1/2008 |
| WO | 2008068245 | A1 | 6/2008 |
| WO | 2009066153 | A2 | 5/2009 |
| WO | 2011127981 | A1 | 10/2011 |
| WO | 2013118030 | A2 | 8/2013 |
| WO | 2016016864 | A1 | 2/2016 |

OTHER PUBLICATIONS

Belgian Search Report from BE Application No. BE 201705020, dated Apr. 4, 2017.
International Search Report from PCT Application No. PCT/IB2017/052245, dated Oct. 25, 2017.

* cited by examiner

SET OF FLOOR PANELS AND METHOD FOR INSTALLING THIS SET OF FLOOR PANELS

BACKGROUND OF THE INVENTION

1. Field of the Invention

The present invention relates to a set of floor panels which is suitable for forming a floor covering, as well as to a method for installing this set of floor panels.

In particular, the invention relates to a set of floor panels which is suitable for forming a floor covering in herringbone pattern.

The floor panels are oblong rectangular and thus comprise a pair of long edges and a pair of short edges. The long as well as the short edges are provided with mechanical coupling parts which allow coupling the floor panels to each other.

Moreover, the set consists of at least two types of floor panels, wherein the coupling parts of the one type of floor panels on one pair of edges are mirrored in respect to the coupling parts of the other type of floor panels at that same pair. Or, more explicitly, this relates to the location of these coupling parts which is mirrored.

2. Related Art

Such set of floor panels is known as such from, amongst others, the documents WO 2004/063491 A1 and WO 2005/054599 A1.

WO 2004/063491 A1 primarily is directed to the use of coupling parts on the pair of short edges which are of the same type as the coupling parts on the pair of long edges. For example, on the long as well as on the short edges coupling parts are applied which can be joined into each other by means of a turning and/or shifting movement. A disadvantage thereof is that the installation of the floor panels in herringbone pattern is not always performed equally smooth.

However, in WO 2004/063491 A1 it is also noted that on the pair of short edges coupling parts can be applied having another configuration than the coupling parts on the pair of long edges. For example, on the pair of short edges coupling parts can be applied which can be joined into each other by means of a downward movement, whereas on the pair of long edges coupling parts are applied which fit into each other by means of a turning movement. In this case, however, from WO 2004/063491 A1 it is not clear at all how the floor panels then can be installed in a herringbone pattern.

WO 2005/054599 A1 indeed shows a manner for installing floor panels, which are provided on the pair of short edges with coupling parts which can be joined into each other by a downward movement, in a herringbone pattern. The manner described in this document allows coupling a floor panel in a single turning movement on the long as on the short edge with adjoining, already installed floor panels, with a herringbone pattern as the result. In the technical field, the single turning movement is also indicated by the term fold-down movement. However, the disclosed floor covering shows the disadvantage that among the mutually coupled floor panels a substantial risk of the occurrence of height differences is present. These height differences are undesired, in view of the fact that primarily they are not visually attractive. Apart therefrom, they, for example, also cause the upper edges of the floor panels to show wear faster there, where these height differences are present. These upper edges then in fact are exposed to exterior influences. The described floor covering also shows the disadvantage that, with dimensional changes in the floor panels, a significant risk of the formations of gaps or cracks or even a risk of floor panels sticking up may be present.

In FIG. 6 of WO 2005/054599 A1, a locking system is presented which is applicable to the short edges of the floor panels. This locking system makes use of a separate insert. However, from WO 2005/054599 A1 it is not clear at all how floor panels with such locking system then have to be installed in a herringbone pattern.

SUMMARY OF THE DISCLOSURE

The present invention primarily aims at an alternative set of floor panels, which is suitable for forming a floor covering in herringbone pattern. In particular, it is an aim of the invention to provide floor panels which, on the one hand, can be smoothly installed in a herringbone pattern and, on the other hand, can be solidly coupled to each other, such that the risk of height differences, the formation of gaps or cracks between the mutually coupled floor panels can be minimized.

To this aim, the invention relates to a set of floor panels, which is suitable for forming a floor covering in herringbone pattern, wherein these floor panels are oblong rectangular and thus comprise a pair of long edges and a pair of short edges; wherein the long as well as the short edges are provided with mechanical coupling means, which allow coupling the floor panels to each other; wherein the one long edge is provided with a male coupling part and the other long edge is provided with a female coupling part; wherein the one short edge is provided with a male coupling part and the other short edge is provided with a female coupling part; wherein the male coupling part on the long edge can be inserted into the female coupling part on the long edge by means of a turning movement; wherein the male coupling part on the long edge can also be inserted into the female coupling part on the short edge by means of a turning movement; and wherein the male coupling part on the short edge can be inserted into the female coupling part on the long edge in one and the same turning movement which is used to insert the male coupling part on the long edge into the female coupling part on the long or short edge; with the characteristic that the male coupling part on the short edge and the female coupling part on the long edge, in a coupled condition thereof, effect a locking in horizontal direction as well as a locking in vertical direction.

The invention, on the one hand, offers the advantage that a floor covering in herringbone pattern can be obtained in a smooth manner. In fact, the configuration of the floor panels allows coupling these floor panels by means of the already above-mentioned fold-down movement and installing them in a herringbone pattern. A floor panel from the set can be coupled at the same time with the long and the short edge to adjacent and already installed floor panels from the set. Preferably, the floor panel then is coupled with the long and the short edge at least to the long edges of the adjacent and already installed floor panels in order to obtain a herringbone pattern. On the other hand, in the obtained floor covering the risk of height differences, the formation of gaps or cracks among the mutually coupled floor panels is minimized. In fact, a good locking is not only present among the mutually coupled long edges, but a solid locking can also be provided among the mutually coupled short and long edges.

In a practical embodiment, the male coupling part on the short edge comprises a first locking element, which, in a coupled condition of this male coupling part and the female coupling part on the long edge, cooperates with a first locking element of this female coupling part in order to effect said locking in vertical direction.

There, where the first locking elements cooperate with each other, preferably a tangent line is defined which runs upward in the direction away from the respective female locking part. This tangent line thus preferably is oriented inclined. The advantage of such cooperation is that, even with minor profile deviations as a result of tolerances occurring when manufacturing the locking elements, it still can effect the vertical locking. In other words, it allows compensating these tolerances. Preferably, said tangent line forms an angle with the horizontal which is smaller than or equal to 45 degrees.

The first locking element of the male coupling part can be realized from the material of the floor panel and in particular in one piece therewith. This can be achieved, for example, by manufacturing this locking element from the material of the floor panel by means of one or more cutting tools or milling tools.

Better, however, the first locking element of the male coupling part is realized as a separate insert.

The insert can be provided in a recess in the male coupling part on the short edge. Preferably, the insert then is provided in the recess in a clamping manner by, for example, over-dimensioning this insert in respect to the recess. In a particularly preferred embodiment, the recess is provided in a distal side or edge of the respective male coupling part.

The use of the insert offers the advantage that the features thereof do not depend on the material of the floor panel. The insert can be configured such that it allows a smooth installation as well as a good vertical locking, and this independent from the material characteristics of the actual floor panel. The material of the insert preferably concerns synthetic material. Examples of synthetic material, which can be applied to this end, are polyvinyl chloride, polypropylene, polyethylene or polyurethane. Further, the material of the insert, in order to increase the strength thereof, may also comprise fibers. For example, mineral fibers, such as glass fibers, can be applied for this purpose. The insert can be manufactured from one and the same material; however, this does not necessarily have to be so. So, the insert can be composed of several materials, which, for example, mutually show a different flexibility. According to the function of the specific portion of the insert, this then can be made of a more or less flexible material. A technique which can be applied for manufacturing the insert from several materials is coextrusion.

It is noted that such insert is known as such from, amongst others, the following documents: WO 2005/054599 A1, WO 2008/068245 A1, WO 2011/127981 A1 and WO 2013/118030 A2. The inserts described in these documents can be applied in the present invention. More in general, any insert which is suitable for being applied for a fold-down type of floor panel can be applied in the present invention.

Preferably, the insert comprises a locking part which, when performing the coupling movement, arrives in a locking position by performing a lateral movement. This lateral movement may concern, for example, a linear movement or a turning or rotational movement. Preferably, the insert, or at least a portion thereof, is elastically deformable and/or displaceable in order to allow said lateral movement.

The lateral movement can be single or dual. In the single movement, the locking part, during the coupling movement, is brought directly from an initial position to a locking position, and this preferably according to a movement in only one a direction. In the dual movement, the locking part, during the coupling movement, is brought indirectly from an initial position to the locking position, and this, for example, by bringing the locking part first according to a direction into an intermediary position and subsequently in the opposite direction from the intermediary position to the locking position.

The principle of the single lateral movement is known as such from, amongst others, the document WO 2011/127981 A1, whereas the principle of the dual lateral movement is known as such from, amongst others, the documents WO 2005/054599 A1 and WO 2013/118030 A2.

It is also noted that the male coupling part on the short edge can be provided with a plurality of locking elements, which, in a coupled condition with the female coupling part on the long edge, respectively cooperate with a plurality of locking elements of the respective female coupling part. The cooperation of this plurality of locking elements then effects the vertical locking. The use of a plurality of locking elements has the advantage that a very solid vertical locking can be provided. Moreover, the reliability of the locking can also be increased: if one pair of the locking elements fails, then there is at least one other pair to compensate for this fail.

In the case that the male coupling part on the short edge is provided with a plurality of locking elements which provide for the locking in vertical direction, those preferably all are made from the material of the floor panel and in particular in one piece therewith.

In a practical embodiment, the male coupling part on the short edge comprises a second locking element, which, in a coupled condition of this male coupling part with the female coupling part on the long edge, cooperates with a second coupling element of the respective female coupling part in order to effect said locking in horizontal direction.

Most appropriate, the second locking element of the male coupling part on the short edge is made from the material of the floor panel and in particular in one piece therewith. This is possible, for example, by manufacturing this locking element with one or more cutting tools or milling tools from the material of the floor panel.

There, where the two locking elements cooperate with each other, they preferably define a tangent line, which runs upward in the direction away from the respective female coupling part. This tangent line thus preferably is running inclined. Such configuration increases the smoothness of interconnecting the respective coupling parts. Preferably, said tangent line forms an angle with the vertical which is smaller than 45 degrees and still better is smaller than or equal to 30 degrees. Such angle offers an excellent compromise between, on the one hand, the smoothness of installation and, on the other hand, the strength of the horizontal locking.

A particularly preferred embodiment shows at least the following characteristics:

- the male coupling part on the short edge comprises the already mentioned first locking element, wherein this first locking element is performed as a separate insert, which is provided in a recess in the male coupling part; and
- the male coupling part on the short edge comprises the already mentioned second locking element, wherein this second locking element is made from the material of the floor panel and in particular is made in one piece therewith; and
- the male coupling part on the short edge comprises a protruding lip, wherein in a distal side or edge of this lip the recess is provided in which the insert is situated, and wherein the second locking element of the male coupling part on the short edge is made in the form of a protrusion on the lower side of the protruding lip.

Preferably, the lower side of the protruding lip, distally from the protrusion, comprises a portion with which it rests on the female coupling part on the long edge in a coupled condition among these coupling parts. This portion is situated proximally from a closing plane defined between the respective coupled edges. Such support offers the advantage that the risk of height differences, which might arise as a result of the floor panels being walked on, can be minimized or even avoided. The tangent line which is defined there, where the mentioned portion rests on the respective female coupling part, preferably is oriented horizontally or approximately horizontally.

In particular, on the lower side of the protruding lip a space is present between this lip and the respective female coupling part. This space preferably extends continuously between said portion of the protruding lip which rests on the female coupling part, and there, where the two locking elements cooperate with each other.

It is particularly advantageous when the male coupling part on the short edge can also be inserted by means of a horizontal or approximately horizontal snap movement into the female coupling part on the long edge. During such snap movement, the respective male coupling part, relatively seen, is moved towards the female coupling part according to a direction perpendicular to the respective edges and in the plane or approximately in the plane of the floor panels and is inserted into the female coupling part with the occurrence of a snap effect. That such snap movement is possible, offers more possibilities in respect to installation, as will be evident from the detailed description.

Performing the snap movement can be facilitated by providing the female coupling part with an elastically bendable part. This elastically bendable part then can be elastically bent when performing the snap movement and thus, so to speak, temporarily enlarge the opening in the female coupling part for inserting the male coupling part. For example, use can be made of an elastically bendable lower lip.

In order to let the second locking elements smoothly engage one behind the other when performing the snap movement, it is advantageous to provide an inclined guiding surface on the lower side of the male coupling part. When performing the snap movement, this guiding surface then preferably cooperates with the distal end of the female coupling part and in particular with the upper side thereof. For example, the distal side or edge of the already mentioned protrusion on the lower side of the male coupling part can be realized as such guiding surface.

It is also noted that the male coupling part on the short edge preferably fits precisely into the female coupling part on the long edge or can fit into it even with a certain play. Thus, in other words, there is preferably no tensioning force which presses the respective short and long edges towards each other at the upper sides thereof. This allows compensating the possible non-perpendicularity of the floor panels. However, the invention does not exclude the presence of such tensioning force. In the case that it is present, though, it can be realized on the basis of the principle described in respect to FIG. 23 of document WO 97/47834.

Preferably, the coupling parts on the long pair of edges respectively are realized in the form of a tongue and a groove which is bordered by an upper and a lower lip, wherein the tongue and groove are provided with locking elements, which, in a coupled condition of the tongue and groove, counteract the moving apart thereof in horizontal direction. By horizontal direction, here the direction is meant which is perpendicular to the respective edges and lies in the plane of the floor panels. Such coupling parts are known as such from, amongst others, document WO 97/47834.

The lower lip preferably protrudes beyond the upper lip. It is preferred that this lower lip comprises a locking element, which then best extends in that portion of the lower lip which protrudes beyond the upper lip. In coupled condition, this locking element then cooperates with a locking element which is situated on the lower side of the tongue.

There, where they cooperate with each other, the locking elements on the tongue and groove preferably define a tangent line which runs upward in the direction away from the groove. This tangent line preferably relates to an inclined tangent line. Preferably, it forms an angle with the vertical which is smaller than 45 degrees and still better is smaller than or equal to 30 degrees.

Preferably, the upper side of the tongue, in coupled condition, cooperates with the lower side of the upper lip. This cooperation results in effecting a locking in vertical direction. There, where this upper and lower side cooperate with each other, preferably a tangent line is defined which is oriented horizontally or approximately horizontally.

In coupled condition, the tongue preferably extends underneath the upper lip over a distance of at least ⅙ times the overall thickness of the floor panel. More preferably, this distance is at least ¼ times the overall thickness of the floor panel and still more preferably even at least ⅓ the overall thickness of the floor panel. It is clear that this distance herein is measured according to the direction perpendicular to the respective edges and in the plane of the floor panels. As the tongue extends relatively far underneath the upper lip, a strong vertical locking is obtained. This strong locking certainly is desired along the coupled long edges.

Preferably, the lower side of the tongue shows a portion with which the tongue, in coupled condition, rests on the upper side of the lower lip. This portion preferably is situated at least in part distally from a closing plane defined between the respective coupled edges. Best, this portion even is situated entirely distal from said closing plane. The support effect provides for that the tongue cannot be pressed further downward. Amongst others, this offers the advantage that the risk of height differences, which might arise as result of the floor panels being walked on, can be minimized or even avoided.

It is also noted that the already mentioned first locking element of the female coupling part on the long edge preferably is formed by the described upper lip.

It is also noted that the second locking element of the female coupling part on the long edge preferably concerns the described locking element on the groove.

The coupling parts on the pair of long edges, inclusive the locking elements, are realized from the material of the floor panel and in particular are made in one piece therewith.

In a particularly advantageous embodiment, the male coupling part on the long edge can also be inserted into the female coupling part on the long edge by means of a horizontal or substantially horizontal snap movement. During such snap movement, the male coupling part, relatively seen, is moved towards the female coupling part according to a direction perpendicular to the respective edges and in the plane or approximately in the plane of the floor panels, and is inserted into the female coupling part, with the occurrence of a snap effect. That such snap movement is possible will offer more possibilities in respect of installation, as will be evident from the detailed description.

Performing the snap movement can be facilitated by providing the female coupling part with an elastically bendable part. This elastically bendable part then can be elastically bent when performing the snap movement and thus, so to speak, temporarily increase the opening in the female coupling part for inserting the male coupling part therein. For example, use can be made of an elastically bendable lower lip.

In order to have the locking elements on the tongue and groove engage one behind the other in a smooth manner when performing the snap movement, it is advantageous to provide an inclined guiding surface on the lower side of the tongue. This guiding surface then, when performing the snap movement, preferably cooperates with the distal end of the female coupling part and in particular with the upper side thereof.

In a particular embodiment, the coupling parts on the pair of long edges are configured such that they, in the coupled condition, provide a tensioning force pressing the coupled long edges at their upper sides towards each other. This principle is known as such from document WO 97/47834, and in the technical field is denominated with the term pretension. This pretension can be realized on the basis of the principle illustrated in FIG. 23 of said WO 97/47834. For example, a lower lip can be applied, which, in coupled condition, is permanently elastically bent and thereby provides the aforementioned tensioning force.

The female coupling part on the short edge can show one or more characteristics of the female coupling part on the long edge. Desirably, this female coupling part on the short edge even is realized identically or approximately identically to the female coupling part on the long edge.

The male coupling part on the long edge preferably can be also inserted into the female coupling part on the short edge by means of a horizontal or substantially horizontal snap movement. As will become evident from the detailed description, this provides more possibilities in respect to installation.

The inventor has found that the present invention can be applied in a particularly advantageous manner with floor panels having a substrate which is realized on the basis of a synthetic material, such as polyvinyl chloride, polyethylene, polypropylene, polyethylene terephthalate and/or polyurethane. In fact, these floor panels have been shown to undergo drastic dimensional changes with changing temperatures. Those may lead to a warping op the floor covering and even to the floor panels moving out of each other. However, the risk thereof can be minimized by means of the present invention by the strong locking which can be provided between the edges amongst each other.

The substrate of these floor panels may or may not be multi-layered, however, preferably comprises at least a substrate layer which is realized on the basis of a composition which shows one or more of the following characteristics, as far as they are not contradictory:

The composition comprises at least a thermoplastic synthetic material.

The composition comprises at least a synthetic material, such as polyvinyl chloride, polyethylene, polypropylene, polyethylene terephthalate, polyurethane and/or an elastomer.

The composition comprises one or more plasticizers in an amount of less than 20 phr and preferably in an amount between 5 and 15 phr. In case that such an amount of plasticizers is applied, this concerns a substrate layer of the rigid or stiff type.

The composition comprises one or more plasticizers in an amount of at least 20 phr. In this case, this concerns a substrate layer of the supple or flexible type.

The composition comprises an inorganic filler, such as chalk, talc and/or limestone.

The composition comprises an organic filler, such as wood, bamboo and/or cork particles.

The composition comprises a mineral filler, such as ceramics.

The composition comprises mineral fiber structures, such as fibers of glass, talc and/or wollastonite.

It is also noted that the presence of a substrate layer of the rigid type, i.e. with an amount of plasticizer of less than 20 phr, is beneficial for the dimensional stability of the floor panels. In combination with the strong locking, this rigid substrate layer then provides for an extremely stable floor covering.

Possibly, the substrate layer is foamed. The advantage thereof is that the density of the substrate layer can be reduced. In this manner, an economization of raw materials and energy can be realized. Also, by foaming the substrate layer can be given new features, such as in the field of comfort, and even more important, in the field of dimensional stability.

It is also noted that the substrate layer can be manufactured according to various possibilities. So, the substrate layer may be manufactured by means of strewing, extrusion, injection molding, calendering and/or coating techniques.

The substrate can be composed of a plurality of substrate layers. These substrate layers can be realized on the basis of a composition as described herein above, however, do not have to be made identical to each other. The substrate layers may differ, for example, on the basis of the amount of applied plasticizers. Herein, this may relate to the combination of a supple substrate layer with a rigid substrate layer.

In a particularly preferred embodiment, the floor panels are of the so-called Luxury Vinyl Tile (LVT) or Wood Plastic Composite (WPC) type. For example, this relates to floor panels which are realized such as described in the document U.S. Pat. No. 9,156,233 B2.

Possibly, the substrate is provided with a reinforcement layer, such as a glass fiber cloth or a glass fleece or a glass net. This reinforcement layer then preferably is incorporated into the substrate. This means that the reinforcement layer then, at the lower as well as at the upper side thereof, is bordered by the material of the substrate. This reinforcement layer assists in increasing the dimensional stability of the floor panels and thus contributes to avoiding the formation of gaps and cracks in the floor covering in herringbone pattern. It is noted that the substrate can be provided with a plurality of reinforcement layers, whether or not incorporated.

The thickness of the floor panels preferably is substantially, thus, for the half thereof or more, formed by the substrate.

The thickness of the floor panels preferably is situated between 2 and 8 mm and more preferably between 3 and 6 mm. This allows realizing the floor panels sufficiently thin, while they still show sufficient strength and stability.

Preferably, the floor panels are decorative. To this aim, they can be composed of a substrate and a top layer situated above the substrate and comprising a decor. This decor preferably comprises a motif or pattern which, for example, can simulate a natural product, such as wood, stone or ceramics. This then concerns, for example, a wood motif or pattern. This motif or pattern then can simulate, for example, wood nerves or wood pores.

The decor preferably relates to a print which, whether or not directly, is provided on an underlying layer of the floor panel. When the print is not applied directly, it then typically is provided on a carrier sheet. This carrier sheet may concern, for example, a synthetic material film, such as a polyvinyl chloride film, polyurethane film, polypropylene film, polyethylene terephthalate film or polyethylene film. Preferably, the carrier sheet is connected to the substrate or another layer of the top layer by means of a thermal lamination process. When providing the print directly on an underlying layer of the floor panel, the so-called direct print, it is not excluded that it is provided on a basic layer or primer provided on the underlying layer. For the direct print, preferably a digital printer, such as an inkjet printer, is applied.

Preferably, the top layer also comprises a translucent or transparent wear layer situated above the decor. This wear layer then forms a protection for the decor. For example, this relates to a synthetic material-based wear layer, which is applied either as a film, whether or not together with the aforementioned printed film, for example, by means of a thermal lamination process, or is provided in liquid condition and subsequently is hardened on the substrate or another layer of the top layer. In the case that the wear layer comprises a film, this preferably concerns a thermoplastic film, in particular a polyvinyl chloride film, a polyurethane film, a polypropylene film, a polyethylene terephthalate film or a polyethylene film.

The top layer can be finished with a lacquer layer, which is applied on said wear layer and/or said decor as a liquid layer and subsequently is hardened. Preferably, this concerns a lacquer layer which can be hardened by UV light or excimer radiation, or a layer which can be hardened by means of a temperature increase. This last-mentioned layer may make use, for example, of blocked isocyanates as cross-linkers. Preferably, a lacquer layer is provided on top of the possible wear layer; however, according to an alternative, the lacquer layer can function as a wear layer.

The top layer can also be provided with embossments, whether or not realized in register with the decor. To this aim, a roller can be applied, such as described as such in PCT/IB2015/055826. The embossments provide the floor panels with a relief, such that they can simulate a natural structure, such as a wood structure, even better. The impressions can be performed, for example, according to a wood nerve pattern.

Apart from the substrate and the top layer, the floor panels can also comprise a backing layer, which is situated underneath the substrate. The counter layer can be realized, for example, on the basis of cork or on the basis of a thermoplastic synthetic material, which preferably is of the supple type. Such rather soft counter layer can provide the floor panels with new features, for example, in the field of comfort and sound absorption. In particular, the counter layer forms a layer with acoustic features. The counter layer can contribute, for example, to the reduction of the sound production of the floor panels, for example, when they are walked on.

As is evident from the above, the invention primarily aims at floor panels which are composed of a substrate, which is realized on the basis of a synthetic material, such as polyvinyl chloride, polyethylene, polypropylene, polyethylene terephthalate and/or polyurethane. However, the invention is not restricted to such floor panels. For example, it is not excluded that the invention is applied with floor panels comprising a wood-based substrate, such as an MDF or HDF substrate. The invention can also be applied to floor panels with a wood-based substrate and a there above-situated wooden top layer, such as a wood veneer top layer. This then concerns floor panels of the so-called engineered wood-type.

That the set of floor panels is suitable for forming a floor covering in herringbone pattern, implicitly implies that this set consists at least of two types of floor panels. Herein, the coupling parts of the one type of floor panels on the one pair of edges are mirrored in respect to the coupling parts of the other type of floor panels on that same pair. To be more precise, it is the location of the coupling parts which is mirrored.

The present invention also relates to a method for installing the set of floor panels. This set consists of at least two types of floor panels, wherein the coupling parts of the one type of floor panels on one pair of edges are mirrored in respect to the coupling parts of the other type of floor panels on that same pair. The method comprises at least the following steps:

- forming a first row by coupling floor panels of the first type to floor panels of the second type, short edge against long edge; and
- forming at least a second row at the first row by coupling floor panels of the one type to floor panels of the other type, short edge against long edge, wherein the floor panels of the second row are installed by means of a single turning movement.

Applying this method offers a particularly smooth installation of the floor covering in herringbone pattern. The floor panels of the second row and possible subsequent rows in fact can all be installed by only making use of the user-friendly turning movement, which in the technical field often is referred to with the term fold-down movement. Moreover, the specific configuration of the floor panels provides for that in the resulting floor covering the risk of the occurrence of height differences, the formation of gaps or cracks among the floor panels is small or at least can be minimized.

In a practical embodiment, said second row is formed by inserting the male coupling part on the short edge of a first floor panel into the female coupling part on the long edge of a second floor panel in one and the same turning movement which is used to insert the male coupling part on the long edge of the first floor panel into the female coupling part on the long or short edge of a third floor panel. Possible further rows can also be installed or placed in this manner.

It is noted that by a horizontal locking a locking is meant which is active in the direction perpendicular to the respective coupled edges and in the plane of the floor panels. By a vertical locking in its turn then a locking is meant which is active in the direction perpendicular to the plane of the floor panels.

It is also noted that the term guiding surfaces does not exclude that these guiding surfaces are curved. In other words, they are not necessarily flat.

It is also noted that by the term closing plane the plane is meant that, from a top view, indicates the closure between the mutually coupled floor panels. In particular, this relates to a vertical plane. Even with floor panels which fit into each other with a play, such closing plane still can be defined. This then rather concerns a theoretical plane indicating the closure when these floor panels are pressed towards each other.

It is also noted that by a turning movement a movement has to be understood wherein the floor panel is turned down with the male coupling part from an inclined position in respect to the floor panel with the female coupling part in order to insert the male coupling part in the female coupling part. Herein, it is possible that in the inclined position the male coupling part is already partially inserted in the female coupling part, however, certainly not completely. By the downward turning movement, the male coupling part then is completely inserted into the female coupling part.

It is also noted that the floor panels, apart from their suitability for being installed in herringbone pattern, can also be used for installing other motifs or patterns.

It is clear that the characteristics in respect to the long edges can also be applied to the short edges, wherein those of the short edges then are applied to the long edges. The characteristics which are mentioned in respect to the long edges thus, in other words, can be projected to the short edges, while those of the short edges then are projected to the long edges.

Moreover, the invention is not restricted to oblong rectangular floor panels, but can be applied with floor panels of any form. In this context, the characteristics which are mentioned in respect to the pair of long and short edges respectively can be applied to a first pair of edges and a second pair of edges. For example, floor panels in the shape of a parallelogram can be applied.

It is also noted that the invention is not limited to floor panels. It can be applied more broadly to any type of panels, such as, for example, to wall panels.

According to a deviating aspect, the invention relates to a set of floor panels which is suitable for forming a floor covering, wherein the floor panels of the set are quadrangular and oblong and thus have a pair of long sides and a pair of short sides, wherein the pair of long sides as well as the pair of short sides is provided with mechanical coupling parts which allow coupling the floor panels to each other, wherein the floor panels of the set have the shape of an inclined parallelogram and the set consists of at least two types of floor panels, wherein the floor panels of the one type, regarding their shape, are mirrored in respect to the floor panels of the other type, and wherein the coupling parts show the following characteristics:

- the coupling parts on the long sides allow coupling a long side of a floor panel to a long side of another floor panel of the same type, by means of a turning movement; and
- the coupling parts on the short sides allow coupling a short side of a floor panel to a short side of a floor panel of another type in one and the same turning movement which is used for coupling a long side of the first-mentioned floor panel to a long side of another floor panel of the same type as the first-mentioned floor panel.

This deviating aspect allows installing the floor panels of the set in herringbone pattern, by means of the fold-down technique. An important advantage is that, for forming this herringbone pattern, it is not necessary that the long sides are compatible to the short ones. Due to the parallelogram shape the herringbone pattern can be installed by coupling the long sides of the panels of the same type to each other and by coupling the short sides of the panels of the one type to the short sides of the panels of the other type. No long side must be coupled to a short side.

The coupling parts on the long sides of both types of floor panels preferably are realized in the form of a tongue and groove, wherein the groove is limited by an upper lip and a lower lip. The lower lip may protrude beyond the upper lip. The tongue and groove preferably are provided with locking elements, which, in coupled condition, counteract the moving apart of the tongue and groove in horizontal direction. Such coupling parts are known as such from document WO 97/47834.

The coupling parts on the short sides of both types of floor panels preferably are realized as a downward-directed upper hook-shaped part and an upward-directed lower hook-shaped part. The upper hook-shaped part comprises a lip with a downward-directed locking element, and the lower hook-shaped part comprises a lip with an upward-directed locking element. In coupled condition, these locking elements counteract the moving apart of the hook-shaped parts in horizontal direction.

Preferably, the hook-shaped parts in coupled condition also effect a vertical locking. This is preferably performed by means of a separate insert. This insert may be made of synthetic material. The insert preferably comprises a locking part which can be brought in a locking position in an elastic manner. This locking part preferably arrives automatically in the locking position during performing of the coupling movement among the short sides. Such insert is known as such from documents WO 2005/054599, WO 2008/068245 and WO 2009/066153.

The insert can be situated in a recess in the lower or upper hook-shaped part. In coupled condition, it then cooperates with a locking element on the other hook-shaped part in order to realize the vertical locking. This locking element preferably is realized in one part with the floor panel indeed. The recess preferably is provided in the upper hook-shaped part and then in particular in the distal side of this hook-shaped part.

It is not excluded that the vertical locking with the hook-shaped parts is realized solely by locking elements realized in one piece with the floor panel.

It is noted that by "mechanical coupling parts" coupling parts are understood which allow realizing a mechanical locking. Thus, no glue or the like is necessary for the locking. However, the use of glue is not excluded.

It is also noted that by an "inclined parallelogram" a parallelogram is understood wherein the adjacent sides are different in length and enclose a non-straight angle.

The set according to the deviating aspect can show one or more of the characteristics which are described herein above before the introduction of this aspect, and such as far as no contradictions will arise. Primarily, this relates to the characteristics relating to the coupling parts on the long sides, the characteristics relating to the male coupling part on the short side, which can be applied to the upper hook-shaped part of the deviating aspect, and the characteristics relating to the substrate, the top layer and the thickness of the floor panels.

BRIEF DESCRIPTION OF THE DRAWINGS

With the intention of better showing the characteristics of the invention, herein below, as an example without an limitative character, some preferred embodiments are described, with reference to the accompanying drawings, wherein.

DETAILED DESCRIPTION OF PREFERRED EMBODIMENTS OF THE INVENTION

Figure 1:
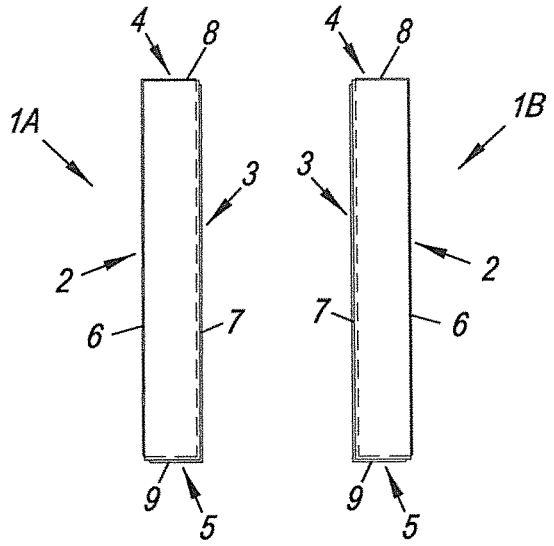
FIG. 1 in top view represents two floor panels from a set according to the invention, as well as a partially finished floor covering in herringbone pattern.

FIG. 1 in top view represents two floor panels 1A-1B from a set of floor panels according to the invention. These floor panels 1A-1B are suitable for forming a floor covering in herringbone pattern, as will become clear from the following.

In FIG. 1 also a partially finished floor covering 1 in herringbone pattern is shown. In this floor covering 1 a plurality of the floor panels 1A-1B are used.

The floor panels 1A-1B are oblong rectangular and thus comprise a pair of long edges 2-3 and a pair of short edges 4-5. The long as well as the short edges 2-3-4-5 are provided with mechanical coupling parts 6-7-8-9, which allow coupling a plurality of such floor panels 1A-1B to each other. The one long edge 2 is provided with a male coupling part 6 and the other long edge 3 is provided with a female coupling part 7. The one short edge 4 is provided with a male coupling part 8 and the other short edge 5 is provided with a female coupling part 9.

From FIG. 1, it is obvious that the floor panel 1A is of another type than the floor panel 1B. The location of the coupling parts 6-7-8-9 in the floor panel 1A namely is mirrored in respect to the location of the coupling parts 6-7-8-9 in the floor panel 1B.

Figure 2:
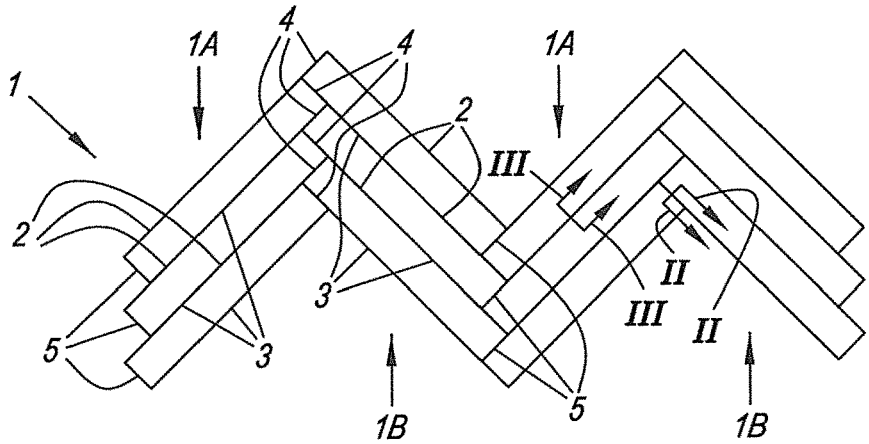
FIG. 2 in an enlarged view represents a cross-section according to line II-II in FIG. 1 and also represents how the coupling parts shown in this cross-section can be inserted into each other.
Figure 2:
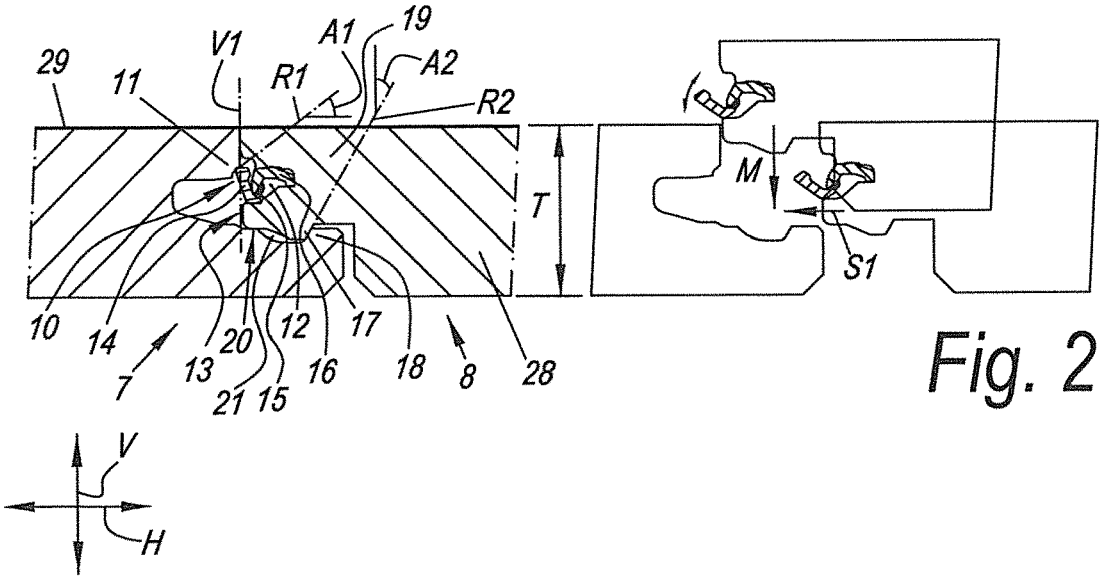
Figure 3:
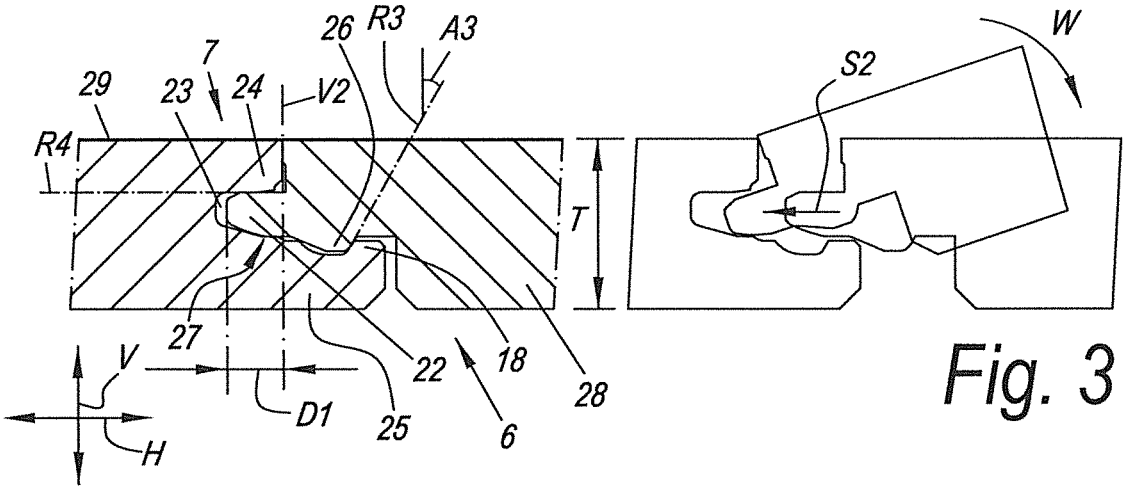
FIG. 3 in an enlarged view represents a cross-section according to line III-III in FIG. 1 and also represents how the coupling parts shown in this cross-section can be inserted into each other.

The appearance of the mechanical coupling parts 6-7-8-9 is described by means of FIGS. 2 and 3.

In FIG. 2, a cross-section according to line II-II in FIG. 1 is represented. This figures thus shows the appearance of the coupling parts 7-8.

Moreover, FIG. 2 also represents how these coupling parts 7-8 can be inserted into each other.

The male coupling part 8 can be inserted into the female coupling part 7 by means of the downward movement M.

Apart therefrom, the male coupling part 8 can be inserted into the female coupling part 7 in one and the same turning movement which is applied for inserting the male coupling part 6 into the female coupling part 7 or 9 of another floor panel. This then relates to the so-called fold-down movement. How this coupling movement then precisely looks, will be described in greater detail by means of FIG. 6.

The male coupling part 8 can also be inserted into the female coupling part 7 by means of a horizontal or substantially horizontal snap movement S1.

The male coupling part 8 and the female coupling part 7 effect a locking in horizontal direction H as well as a locking in vertical direction V.

The male coupling part 8 comprises a locking element 10 which cooperates with the locking element 11 of the female coupling part 7 in order to effect the locking in vertical direction V.

In the example, the locking element 10 is realized as a separate insert. There, where the insert cooperates with the locking element 11, a tangent line R1 is defined, which runs upward in the direction away from the female coupling part 7. This tangent line R1 forms an angle A1 with the horizontal which preferably is smaller than 45 degrees. In the represented example, the angle A1 is approximately equal to 38 degrees.

The insert is provided in a recess 12 in the male coupling part 8. In the example, this recess 12 is provided in a distal side or edge 13 of the male coupling part 8.

The insert comprises a locking part 14, which, when performing the coupling movement, arrives in a locking position by performing a lateral movement. In the example, this locking part 14, via a part 15, is connected to an attachment part 16 with which the insert is provided in the recess 12. The part 15 is manufactured of another, more flexible or more elastic material than the locking part 14 and the attachment part 16. This part 15 allows that the locking part 14 performs said lateral movement. This lateral movement here concerns a lateral turning or rotation movement, which in particular is dual.

In coupled condition, the locking element 22 cooperates with the lower side of the upper lip 14. There, where they cooperate with each other, a tangent line R2 is defined, which forms an angle A2 with the horizontal with is different from zero.

The male coupling part 8 also comprises the locking element 17, which cooperates with the locking element 18 in order to effect said locking in horizontal direction H.

The locking element 17 is made from the material of the floor panel and in one piece therewith.

There, where the locking elements 17-18 cooperate with each other, a tangent line R2 is defined, which runs upward in the direction away from the female coupling part 7. This tangent line R2 forms an angle A2 with the vertical which preferably is smaller than 45 degrees and more preferably is smaller than or equal to 30 degrees. In the represented example, the angle A2 is approximately equal to 30 degrees.

In general, the male coupling part 8 here comprises a protruding lip 19. In the distal side or edge 13 of this lip 19, the recess 12 is provided. The locking element 17 is realized in the form of a protrusion on the lower side of the lip 19.

Distally from the protrusion, the lower side of the lip 19 comprises a portion 20 with which it rests on the female coupling part 7. This portion 20 is situated proximally from the closing plane V1 defined between the coupled edges 3 and 4.

Between the lower side of the lip 19 and the female coupling part 7 a space 21 is present. This space 21 extends continuously between the portion 20 and there, where the locking elements 17-18 cooperate with each other.

In the example, the male coupling part 8 fits precisely into the female coupling part 7. This has as a result that in this coupling there is no tensioning force present which presses the edges 3-4 towards each other at their upper sides. This has the advantage that even with non-straight floor panels these edges 3-4 still can be coupled to each other in a smooth manner. It can even be still more advantageous that the male coupling part 8 fits into the female coupling part 7 with a certain play.

In FIG. 3, a cross-section is represented according to line III-III in FIG. 1. This figure thus shows the appearance of the coupling parts 6-7.

Moreover, FIG. 3 also shows how these coupling parts 6-7 can be inserted into each other.

The male coupling part 6 can be inserted into the female coupling part 7 by means of the turning movement W.

The male coupling part 6 can also be inserted into the female coupling part 7 by means of a horizontal or substantially horizontal snap movement S2.

The coupling parts 6-7 are realized as a tongue 22 and a groove 23, respectively. The groove 23 is bordered by an upper lip 24 and a lower lip 25. The tongue 22 and the groove 23 are provided with locking elements 26-18, which counteract the moving apart of the tongue 22 and groove 23 in horizontal direction H.

The lower lip 25 protrudes beyond the upper lip 24. In that part of the lower lip 25 that protrudes beyond the upper lip 24, the lower lip 25 comprises the locking element 18. This locking element 18 cooperates with the locking element 26 on the lower side of the tongue.

There, where the locking elements 26-18 cooperate with each other, a tangent line R3 is defined, which runs upward in the direction away from the groove 23. This tangent line R3 forms an angle A3 with the vertical, which preferably is smaller than 45 degrees and still more preferably is smaller than or equal to 30 degrees. In the example, the angle A3 is approximately equal to 30 degrees.

The upper side of the tongue 22 cooperates with the lower side of the upper lip 24. There, where this upper and lower sides cooperate with each other, a tangent line R4 is defined, which is situated horizontally or approximately horizontally.

The tongue 22 extends underneath the upper lip 14 over a distance D1 of at least ⅙ times the overall thickness T of the floor panel, and preferably over a distance D1 of at least ¼ times the overall thickness T of the floor panel and still more preferably over a distance D1 of at least ⅓ times the overall thickness T of the floor panel. In the example, the distance D1 is approximately ⅓ times the thickness T.

The lower side of the tongue 22 comprises a portion 27 with which the tongue 22 rests on the upper side of the lower lip 25. This portion 27 is situated at least partially distally from the closing plane V1 defined between the coupled edges 2-3. In the example, this portion is situated even entirely distal from the closing surface V1.

It is clear that the first locking element 11 of the female coupling part is formed by the upper lip 24 and that the second locking element 18 concerns the locking element on the lower lip 25.

The coupling parts 6-7 are realized from the material of the floor panel and in one piece therewith.

It is also noted that the coupling parts 6-7 can be configured such that they, in the coupled condition, provide for a tensioning force, which presses the coupled edges 2-3 towards each other at their upper sides. As already described in the introduction, to this aim then the principle of FIG. 23 of the document WO 97/47834 can be applied. Then, the lower lip 25, for example, can be permanently bent downward in the coupled condition.

In the example, the female coupling part 9 on the short edge 5 is made identical to the female coupling part 7 on the long edge 3. Thus, it is not explicitly represented.

Considering that the coupling parts 7 and 9 are identical, thus the male coupling part 6 can also be inserted into the female coupling part 9 by means of the turning movement W, as well as by means of the snap movement S2.

Figure 4:
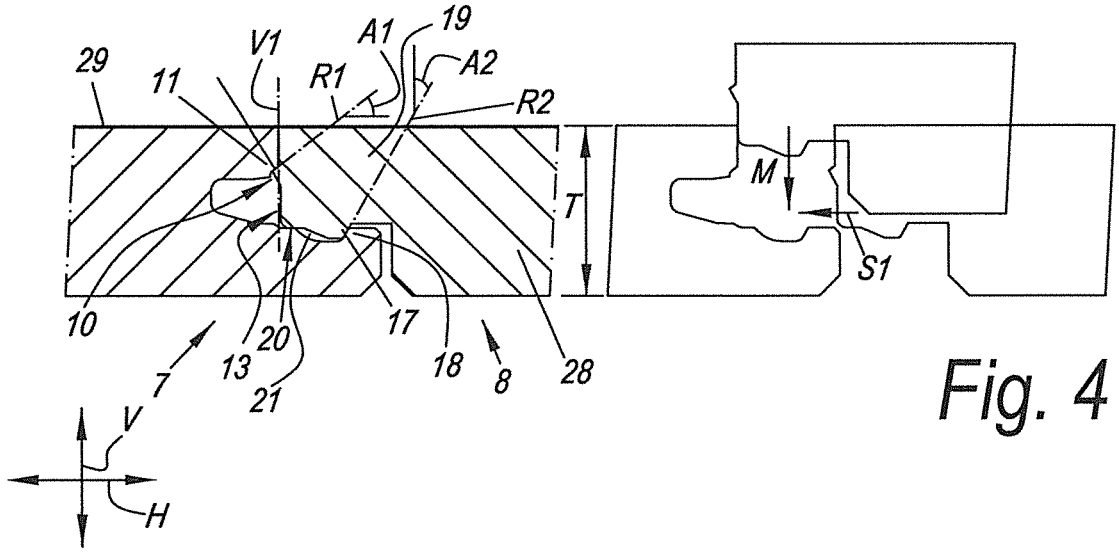
FIG. 4 represents a variant of the coupling parts shown in FIG. 2.

In FIG. 4, another variant of the male coupling part 8 is represented. In this variant, the locking element 10 is realized from the material of the floor panel and in one piece therewith.

The floor panels 1A-1B preferably are composed at least of a substrate 28 and a top layer 29 situated above the substrate 28. The substrate 28 can be realized as described in the introduction and preferably is realized on the basis of a composition which comprises at least a synthetic material, such as polyvinyl chloride, polyethylene, polypropylene, polyethylene terephthalate, polyurethane and/or elastomer. The top layer 29 preferably comprises a decor as well as a transparent or translucent wear layer situated above the decor. The detailed composition of the top layer 29 is not represented in FIGS. 2 to 4.

The thickness T of the floor panels 1A-1B preferably is situated between 2 and 8 mm, wherein a thickness T between 3 and 6 mm is even more desirable.

Figure 6:
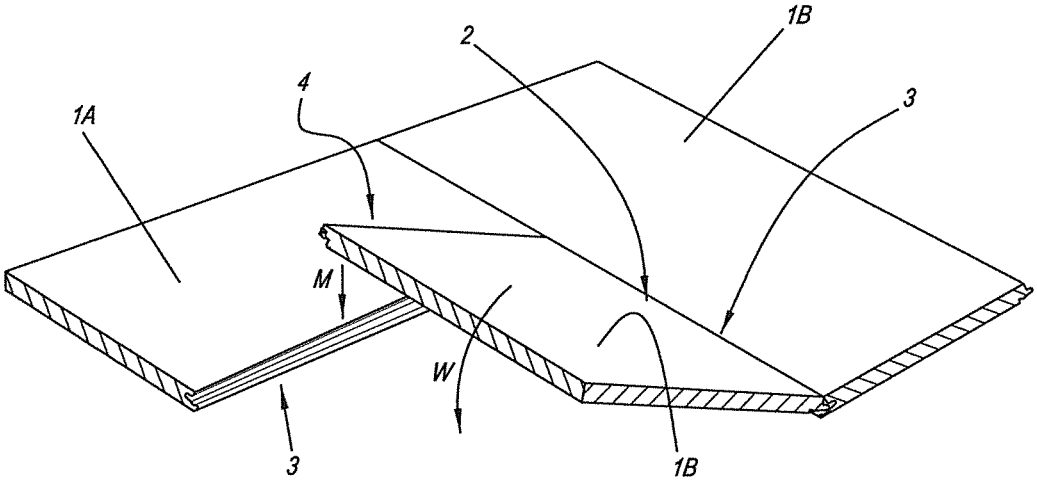
FIG. 6 in an enlarged manner and in perspective view shows what is indicated by F6 in FIG. 5.

How the floor covering 1 shown in FIG. 1 can be achieved will be described by means of FIGS. 5 to 7.

Figure 5:
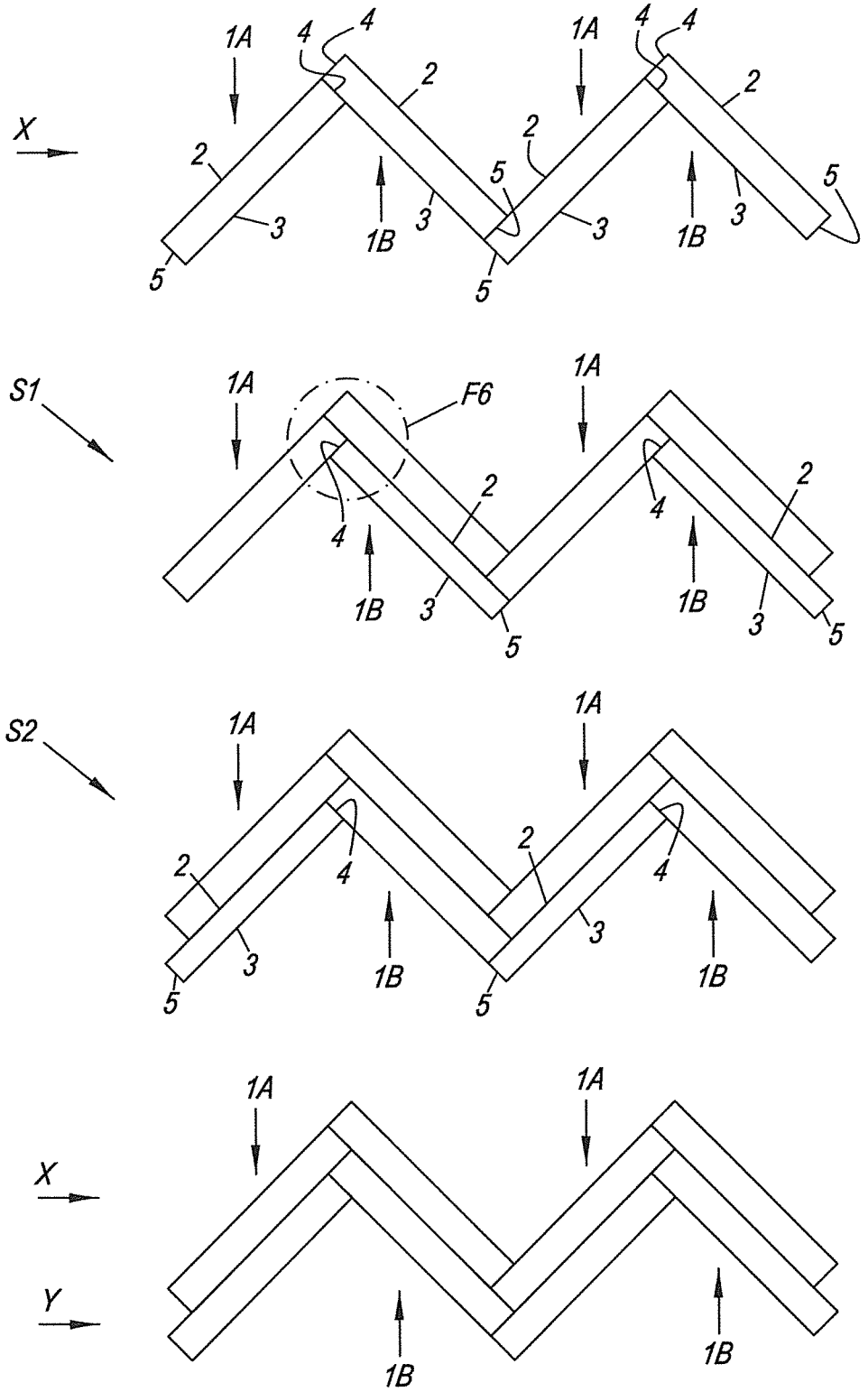
FIG. 5 represents a method according to the invention for installing a plurality of the floor panels from FIG. 1 in herringbone pattern.

In FIG. 5, a first possible method is shown for forming the floor covering of FIG. 1.

Forming the first row X is performed by coupling floor panels 1A to floor panels 1B. The short edge 4 is coupled to the long edge 3.

The second row Y is formed by coupling, in a first step S1, the floor panels 1B with the long edge 2 to the long edge 3 and the short edge 5 of the already installed floor panels 1B-1A of the first row X by means of the turning movement W. Moreover, in that same movement W the short edge 4 of the floor panel 1B can be coupled to the long edge 3 of the already installed floor panel 1A of the first row X. How the aforementioned turning movement W precisely is looking, is illustrated in FIG. 6. This figure represents to a larger scale and in perspective view what is indicated by F6 in FIG. 5.

In an analogous manner, in a second step S2 the floor panels 1A can be installed, which results in finishing the second row Y. It is clear that further rows of the floor covering can be installed in the same manner.

Figure 7:
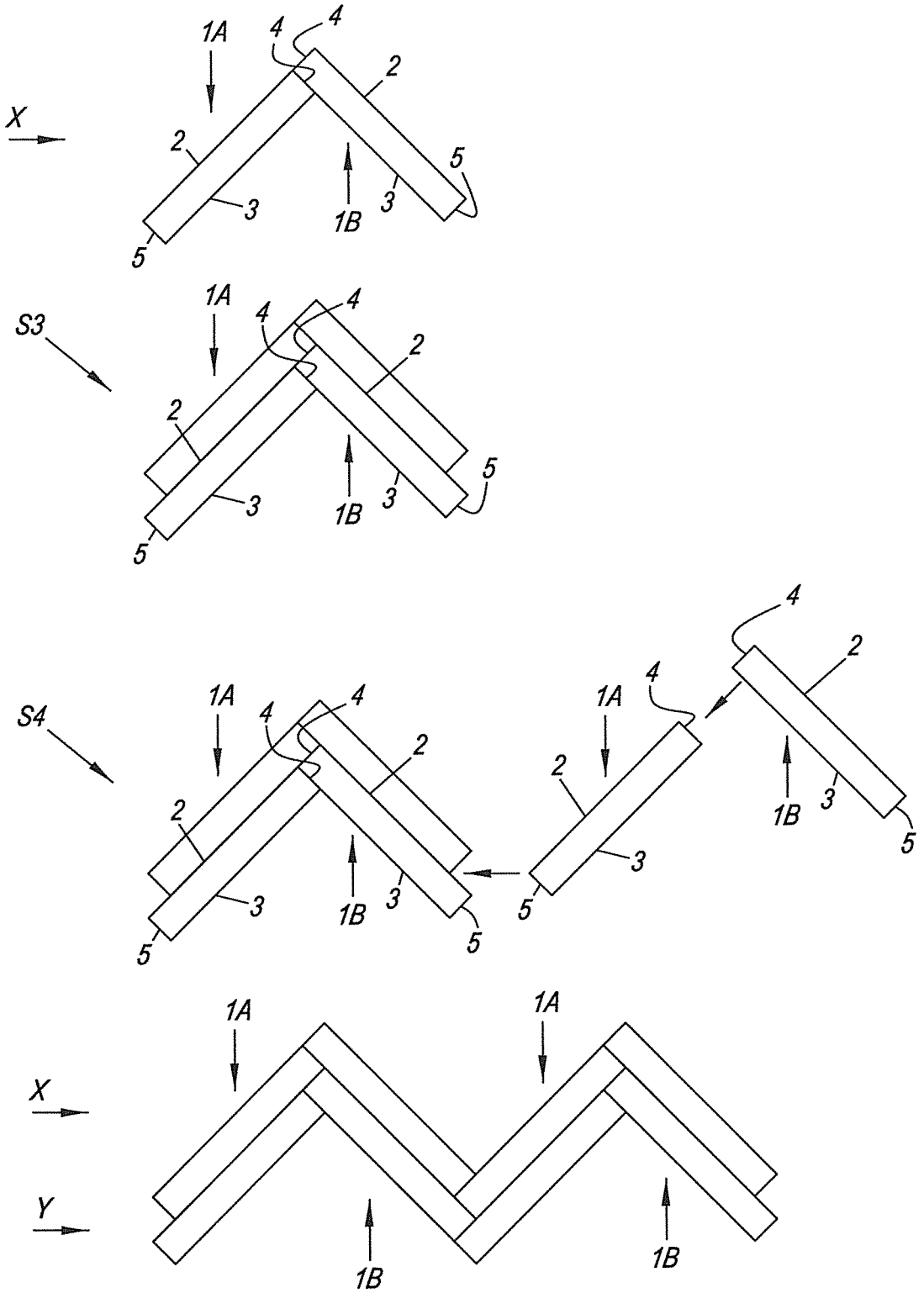
FIG. 7 represents an alternative of the method from FIG. 5.

In FIG. 7, a second possible method is shown for forming the floor covering 1 of FIG. 1. This method is possible in that the coupling parts 6-7-8-9 also allow a horizontal or approximately horizontal snap coupling movement.

In FIG. 7, it is started with installing of an only partially finished first row X of the floor covering.

Thereafter, in a step S3 already the partial installation of the second row Y is started. Herein, the floor panel 1B is coupled with the long edge 2 to the long edge 3 of the already installed floor panel 1B of the first row X by means of the turning movement W. In that same movement W, the short edge 4 of the floor panel 1B can be coupled to the long edge 3 of the already installed floor panel 1A of the first row X. In an analogous manner, the floor panel 1A in the second row Y is installed.

In a following step S4, the installation of the first row X continues. In order to install the floor panel 1A, in a convenient manner use is made of the possibility of snapping. For example, the long edge 2 of the floor panel 1A is snapped into the short edge 5 of the floor panel 1B from the first row X, and the short edge 5 is snapped into the long edge 2 of the floor panel 1B from the second row Y. According to an alternative, the turn-snap technique can be applied, wherein then the long edge 2 is coupled, via a turning movement, to the short edge of the floor panel B from the first row X and then the short edge 5 is snapped into the long edge 2 of the floor panel from the second row Y. The following floor panel 1B can be installed in the first row X by snapping the long edge 3 to the short edge 4 of the then already installed floor panel 1A.

Thereafter, one may further continue with the installation of the second row Y in a manner analogous to step S3.

Figure 8:
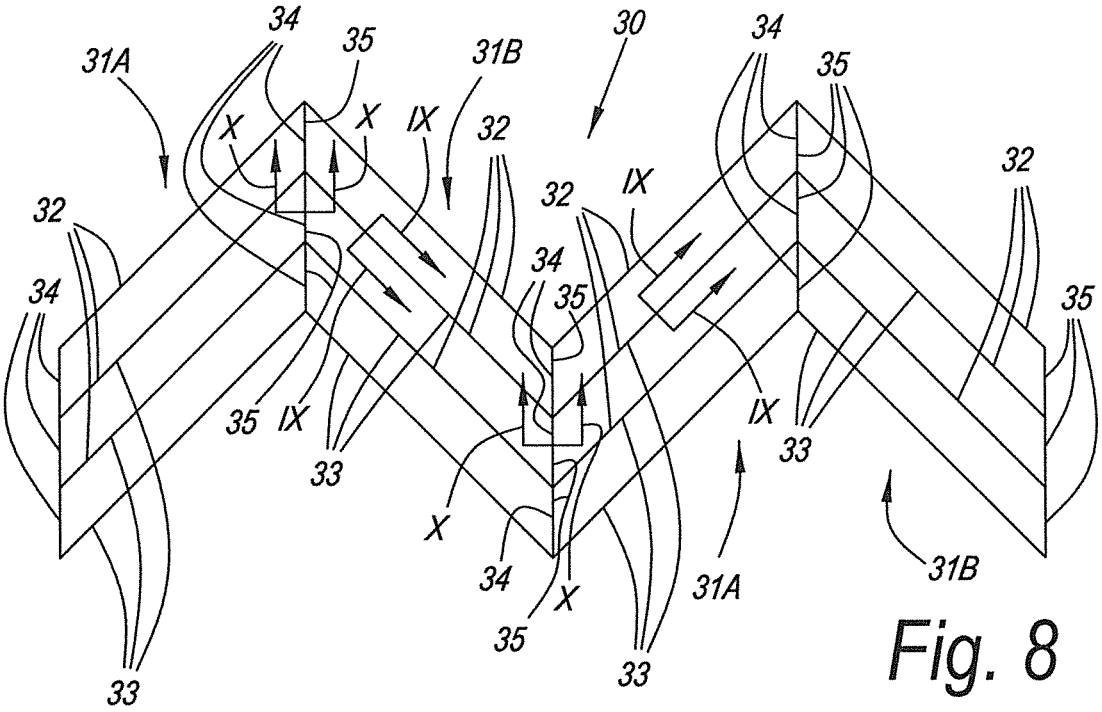
FIG. 8 in top view represents a floor covering in herringbone pattern which is realized by means of the set of floor panels according to the deviating aspect of the invention.

FIG. 8 in top view shows a floor covering 30 in herringbone pattern, or at least a part of this floor covering, wherein this pattern is realized by means of a set of floor panels 31 according to the deviating aspect. The floor panels 31 have the shape of an inclined parallelogram. They comprise a pair of parallel long sides 32-33 and a pair of parallel short sides 34-35. The long sides 32-33 enclose a non-straight angle with the short sides 34-35. The set consists of two types of floor panels 31, namely the floor panels 31A and the floor panels 31B. In respect to their shape, the floor panels 31A are mirrored in respect to the floor panels 31B. The floor panels 31, at their long as well at their short sides 32-33-34-35, are provided with mechanical coupling parts with which the floor panels 31 are coupled to each other. The form of these coupling parts will be described in greater detail with reference to FIGS. 9 and 10. From FIG. 8 is clear that the herringbone pattern is formed without coupling a long side and a short side. The long sides 32-33 of the one type of floor panels 31A are coupled to each other, the long sides 32-33 of the other type of floor panels 31B are coupled to each other, and the short sides 34-35 of the one type of floor panels 31A are coupled to the short sides 34-35 of the other type of floor panels 31B. Thus, there is no compatibility required between the long sides 32-33 and the short sides 34-35.

Figure 9:
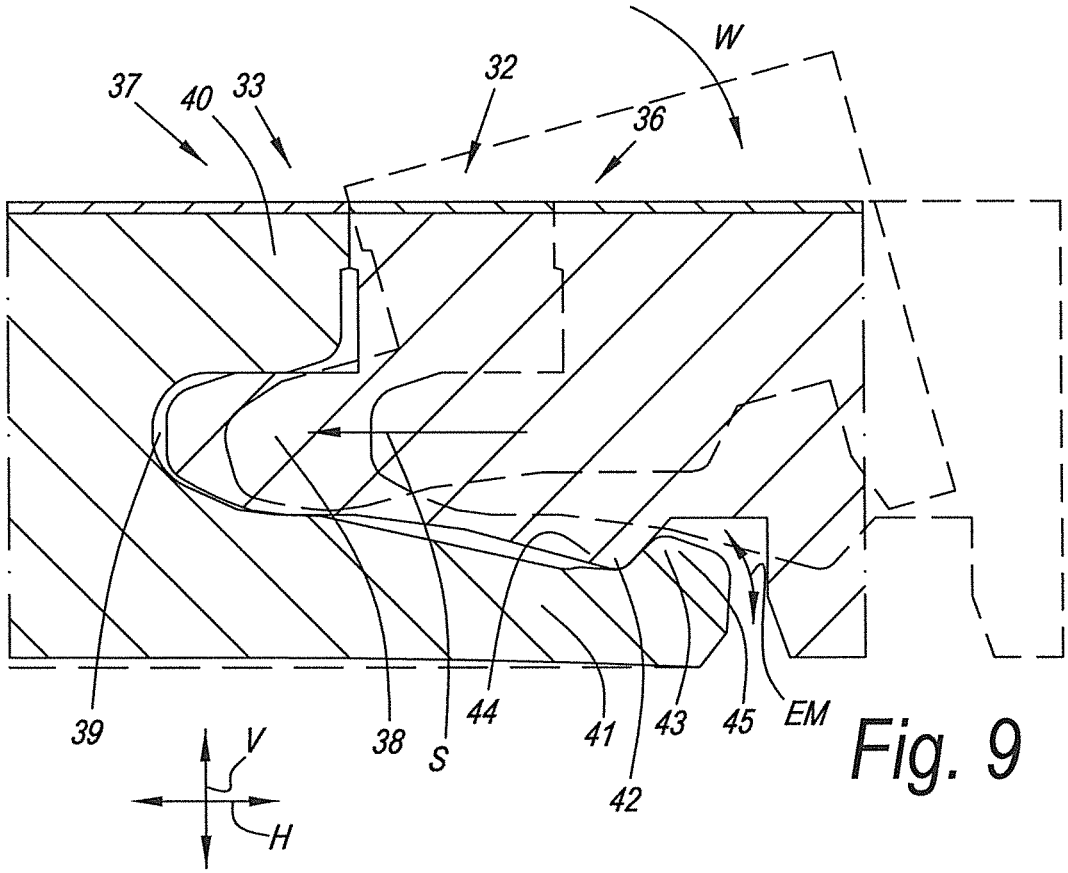
FIG. 9 in an enlarged view represents a cross-section according to line IX-IX in FIG. 8.

FIG. 9 represents the coupling parts 36-37 on the long sides 32-33 in coupled condition. These coupling parts 36-37 allow that the long side 32 of a floor panel 31A or 31B can be coupled to the long side 33 of another floor panel 31 of the same type by means of the turning movement W. The coupling parts 36-37 are realized as a tongue 38 and a groove 39. The groove 39 is bordered by an upper lip 40 and a lower lip 41. The lower lip 41 protrudes beyond the distal extremity of the upper lip 40. Locking elements 42-43 are present, which provide for a locking in the horizontal direction H. These locking elements 42-43 consist of a protrusion 44 on the lower side of the tongue 38 and an upward-directed locking element 45 as a component of the lower lip 41.

It is noted that the coupling parts 36-37 can also allow that the long side 32 of a floor panel 31A or 31B can be coupled to the long side 33 of another floor panel 31 of the same type by means of a horizontal or substantially horizontal translation or snap movement S. With this movement S a snap effect occurs. This snap effect is the result of the elastic movement EM performed by the lower lip 41 during the translation movement S.

It is possible that the lower lip 41 in coupled condition is elastically bent and thus provides a tensioning force which presses the long sides 32-33 towards each other. This is also denominated "pretension" and is known as such from document WO 97/47834. In FIG. 9, this is the case due to the presence of the downward-bent lip 41.

It is also noted that it is not required that the coupling parts 36-37 on the long sides 32-33 of the one type of floor panels 31A are identical to the coupling parts 36-37 on the long sides 32-33 of the other type of floor panels 31B, which here indeed is the case. There is no compatibility required between these coupling parts, as is clear from FIG. 8.

Figure 10:
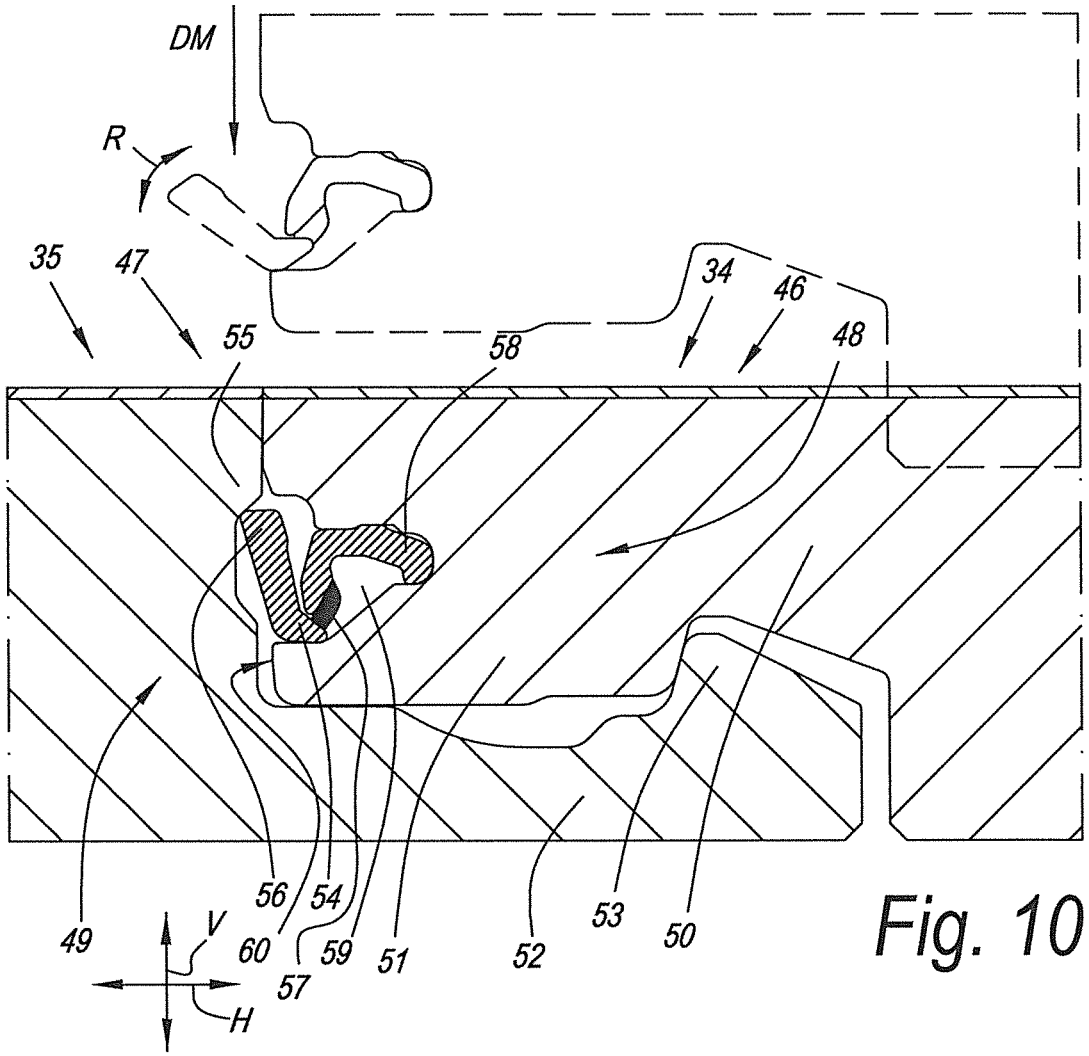
FIG. 10 in an enlarged view represents a cross-section according to line X-X in FIG. 8.
Figure 11:
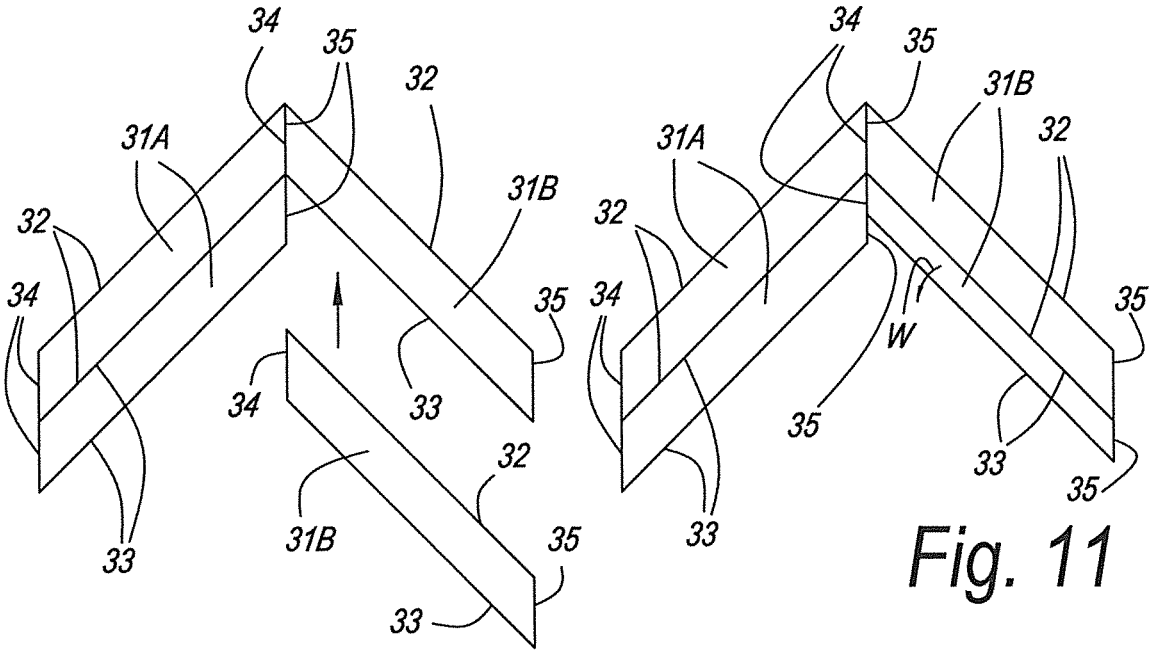
FIG. 11 represents how the floor panels of FIG. 8 can be coupled.

FIG. 10 shows the coupling parts 46-47 on the short sides 34-35 in coupled condition. These coupling parts 46-47 allow that the short side 34 of a floor panel 31A or 31B can be coupled to the short side 35 of a floor panel 31 of the other type in one and the same turning movement W which is used for coupling the long side 32 of the first-mentioned floor panel 31A or 31B to the long side 33 of another floor panel 31 of the same type as the first-mentioned floor panel 31A or 31B. The turning movement W entails a downward coupling movement DM between the short sides 34-35. How this precisely is functioning is illustrated in FIG. 11. In this figure, the floor panel 31B to be installed is shown, as well as the already installed panels 31A and 31B. The floor panel 31B to be installed is brought into an inclined position, wherein the tongue 38 on the side 32 of this panel 31B is partially inserted into the groove 39 on the side 33 of the installed panel 31B and the coupling part 46 on the short side 34 is situated above the coupling part 47 on the short side 35 of the installed floor panel 31A. From this inclined position, the floor panel 31B to be installed is turned downward, according to the movement W, by which the long side 32 as well as the short side 34 of this panel 31B are coupled. The situation is analogous when starting from a floor panel 31A to be installed.

The coupling parts 46-47 are realized as a downward-directed upper hook-shaped part 48 and an upward-directed lower hook-shaped part 49. The upper hook-shaped part 48 comprises a lip 50 with a downward-directed locking element 51, and the lower hook-shaped part comprises a lip 52 with an upward-directed locking element 53. The locking elements 51 and 53 provide for the locking in the horizontal direction H.

The hook-shaped parts 48-49 also realize a locking in the direction V. To this aim, a separate insert 54 cooperates with the locking element 55. The insert 54 consists of three parts: a locking part 56, a connection part 57 and an attachment part 58. The insert is made of synthetic material by means of coextrusion. The connection part 57 is made more flexible than the other parts 56 and 58. It provides for that the locking part 56 can be brought in the locking position in an elastic manner. During the coupling movement, the locking part 56 performs a rotational movement R and automatically arrives in the locking position. The insert 54 is provided with the attachment part 58 in the recess 59. The recess 59 is provided in the distal side 60 of the upper hook-shaped part 48.

It is noted that the coupling parts 46-47 also allow that the short side 34 of a floor panel 31A or 31B can be coupled to the short side 35 of a floor panel 31 of the other type by means of a horizontal or substantially horizontal translation or snap movement, wherein a snap effect occurs with this movement. This snap effect is the result of the elastic movement performed by the lip 52 during the translation movement.

Further, the coupling parts 46-47 also allow that the short side 34 of a floor panel 31A or 31B can be coupled to the short side 35 of a floor panel 31 of the other type by means of a turning movement.

It is possible that the lip 52 of the lower hook-shaped part 49 in coupled condition is elastically bent and in this manner provides a tensioning force pressing the short sides 34-35 towards each other. This is also denominated "pretension" and in such system with hook-shaped coupling parts is known from document BE 2015/5686.

Figure 12:
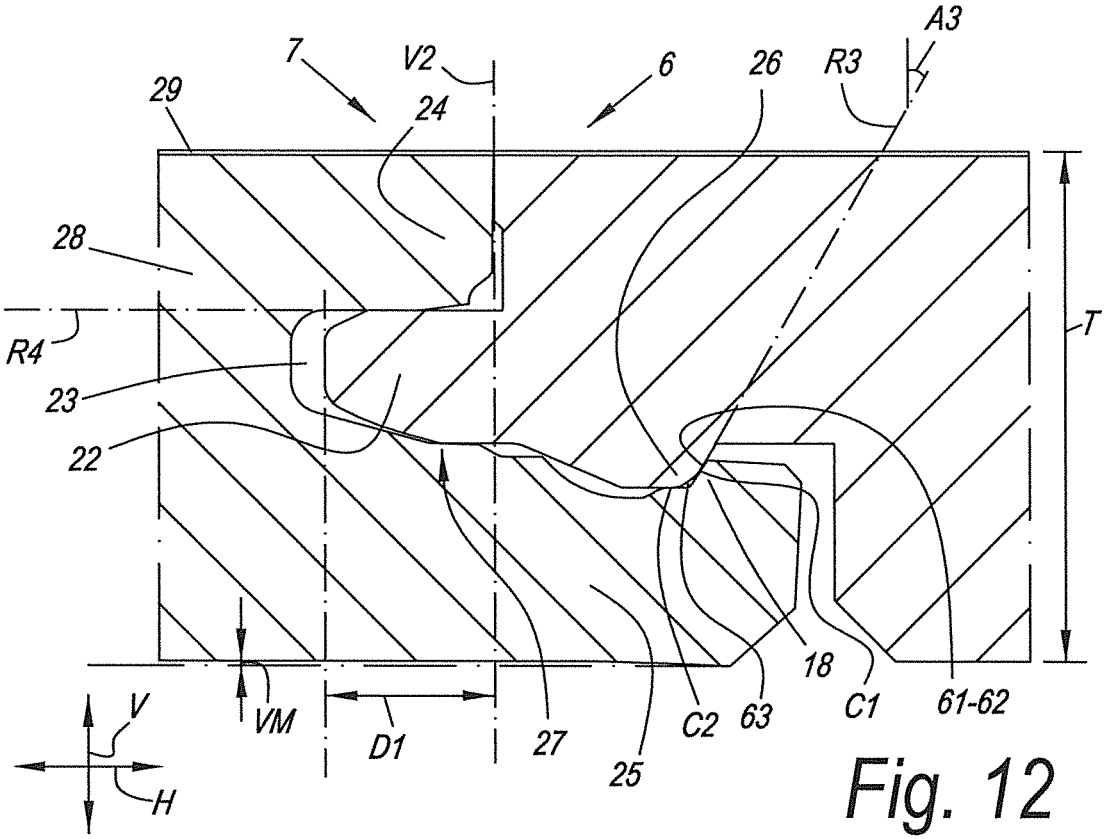
FIG. 12 represents a variant of the coupling parts represented in FIG. 3.

FIG. 12 represents a variant of the coupling parts 6-7 which are represented in FIG. 3. The contact which is formed between the locking elements 18 and 26 is indicated by reference C1. This contact C1 is formed by locking surfaces 61-62 cooperating with each other. The particularity of the coupling parts 6-7 of FIG. 12 is that next to or close to the contact C1 a contact C2 is formed. This contact C2 is formed between the lower side of the tongue 22 and the upper side of the lower lip 25. The contact C2 can be situated directly next to the contact C1, such that actually a single contact is formed. Or, as is the case in FIG. 12, the contact C2 can be separated from the contact C1 by an intermediate space or free space 63. In FIG. 12, the contact C2 is situated closer to the vertical closing plane V2 than the contact C1. However, in a variant the contact C2 can be situated farther from the closing plane V2 than the contact C1. For example, the contact C1 then is situated on the upper side of the locking element 18.

The contact C2 provides for that friction at the location of the contact C1 is counteracted. This friction implies that the locking surfaces 61-62 move relatively in mutual respect. Such friction may occur, for example, when the floor panels are walked upon. Counteracting this friction reduces the risk of creaking noises which may occur as a result of the friction. This is particularly advantageous when the substrate 28 is wood-based.

The presence of the contact C2 has proven particularly advantageous when a tensioning force is present in the coupling parts 6-7 which presses the coupled edges towards each other. In FIG. 12, this tensioning force is provided by the downward-bent lower lip 25. The bending VM of this lip 25 is illustrated.

Figure 13:
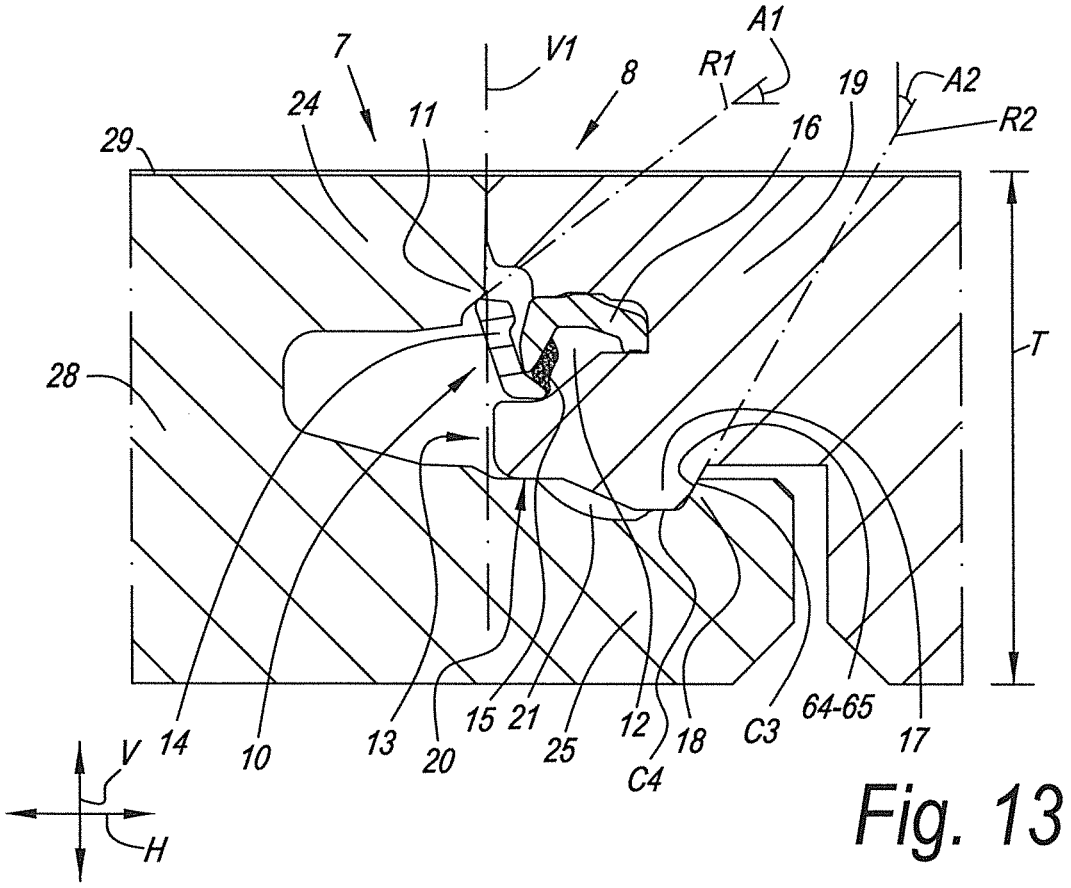
FIG. 13 represents a variant of the coupling parts represented in FIG. 2.

FIG. 13 represents a variant of the coupling parts 7-8 which are represented in FIG. 2. The contact which is formed between the locking elements 17 and 18 is indicated by reference C3. This contact C3 is formed by locking surfaces 64-65 cooperating with each other. The coupling part 7 is made identical to the coupling part 7 of FIG. 12. The coupling part 8 is realized such that apart from the contact C3 a contact C4 is formed. This contact C4 is formed between the lower side of the lip 19 and the upper side of the lower lip 25. In the example, both contacts C3 and C4 form a single contact, however, it is not excluded that they are separated by an intermediate space or free space. Such contact C4 reduces the risk of creaking noises.

It is also noted that the variant of FIG. 12 can be applied in combination or not in combination with the one of FIG. 13.

The present invention is in no way limited to the embodiments described herein above, on the contrary may such methods and floor panels be realized according to various variants, without leaving the scope of the present invention.

The invention claimed is:

1. A set of floor panels, which is suitable for forming a floor covering in herringbone pattern, wherein these floor panels are oblong rectangular and comprise first and second long edges and first and second short edges;

wherein the first and second long edges and the first and second short edges are provided with mechanical coupling means, which allow coupling the floor panels to each other;

wherein the first long edge is provided with a male coupling part and the second long edge is provided with a female coupling part;

wherein the first short edge is provided with a male coupling part and the second short edge is provided with a female coupling part;

wherein the male coupling part on the first long edge can be inserted into the female coupling part on the second long edge by means of a turning movement;

wherein the male coupling part on the first long edge can be inserted into the female coupling part on the second short edge by means of a turning movement;

wherein the male coupling part on the first short edge can be inserted into the female coupling part on the second long edge in one and the same turning movement which is used to insert the male coupling part on the first long edge into the female coupling part on the second long or short edges; and wherein the male coupling part on the first short edge and the female coupling part on the second long edge, in a coupled condition thereof, effect a locking in a horizontal direction and in a vertical direction;

wherein the male coupling part on the first short edge comprises a first locking element, and the female coupling part on the second long edge comprises a first locking part, the first locking elements of the first short edge and the second long edge cooperate to effect locking in the vertical direction; and wherein the first locking element of the male coupling part is realized as a separate insert;

wherein the separate insert is provided in a recess defined by the male coupling part on the first short edge, the recess formed on a distal side or edge of the male coupling part; and wherein the separate insert comprises a locking part pivotally connected to an attachment part secured to the male coupling part, the locking part is arranged for providing a coupling movement such that a locking position is performed by pivotal movement from a recess defined by the male coupling part on the first short edge into a second recess formed by the female coupling part of the second long edge.

2. The set of floor panels according to claim 1, wherein a first tangent line is defined at a location where the insert cooperates with the respective locking element and runs upward in a direction away from the respective female locking part; and wherein the first tangent line forms an angle with a horizontal plane of one of said floor panels which is smaller than or equal to 45 degrees.

3. The set of floor panels according to claim 1, wherein the insert or at least a portion thereof is elastically deformable and/or displaceable in order to allow said lateral movement.

4. The set of floor panels according to claim 3, wherein the locking part, when performing the coupling movement, performs a lateral turning or rotational movement.

5. The set of floor panels according to claim 1, wherein the male coupling part on the first short edge can be inserted into the female coupling part on the second long edge by means of a horizontal or substantially horizontal snap movement.

6. The set of floor panels according to claim 1, wherein the male coupling part on the first short edge either fits precisely into the female coupling part on the second long edge or fits therein with play.

7. The set of floor panels according to claim 1, wherein the coupling parts on the first and second long edges are made in the form of a tongue and a groove, respectively;

wherein the groove is bordered by an upper and a lower lip; and wherein the tongue and groove are provided with locking elements, which, in a coupled condition of the tongue and groove, counteract the moving apart thereof in horizontal direction.

8. The set of floor panels according to claim 7, wherein the lower lip protrudes beyond the upper lip;

wherein the lower lip comprises a locking element situated at a part of the lower lip that protrudes beyond the upper lip; and wherein the locking element of the lower lip in the coupled condition cooperates with a locking element on the lower side of the tongue.

9. The set of floor panels according to claim 7, wherein the locking elements on the tongue and groove, there, where they cooperate with each other, define a second tangent line which runs upward in the direction away from the groove; and wherein the second tangent line forms an angle with the vertical which is smaller than 45 degrees.

10. The set of floor panels according to claim 7, wherein the upper side of the tongue, in a coupled condition of the tongue and groove, cooperates with the lower side of the upper lip; and wherein there, where the upper side of the tongue and the lower side of the upper lip cooperate with each other, a third tangent line is defined which is oriented horizontally or approximately horizontally relative to a horizontal plane of one of said floor panels.

11. The set of floor panels according to claim 7, wherein the tongue, in a coupled condition with the groove, extends underneath the upper lip over a distance of at least ⅙ times an overall thickness of the floor panels.

12. The set of floor panels according to claim 7, wherein the lower side of the tongue shows a portion with which the tongue, in a coupled condition with the groove, rests on the upper side of the lower lip; and wherein this portion, in the coupled condition, is situated at least in part distally from a closing plane defined between the respective edges.

13. The set of floor panels according to claim 1, wherein the male coupling part on the first long edge can be inserted into the female coupling part on the second long edge by means of a horizontal or substantially horizontal snap movement.

14. The set of floor panels according to claim 1, wherein the coupling parts on the first and second long edges are configured such that they, in the coupled condition, provide a tensioning force pressing the coupled first and second long edges at their upper sides towards each other such that at least one of the coupling parts is elastically bent in the coupled condition.

15. The set of floor panels according to claim 1, wherein the male coupling part on the first long edge can be inserted into the female coupling part on the second short edge by means of a horizontal or substantially horizontal snap movement.

* * * * *